US006501036B2

(12) United States Patent
Rochon et al.

(10) Patent No.: US 6,501,036 B2
(45) Date of Patent: Dec. 31, 2002

(54) SEALED BOARD-MOUNTED ELECTRICAL SWITCH

(75) Inventors: Sylvain Rochon, Dole (FR); Laurent Bouvier, Monnieres (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/939,018

(22) Filed: Aug. 24, 2001

(65) Prior Publication Data

US 2002/0056627 A1 May 16, 2002

Related U.S. Application Data

(63) Continuation-in-part of application No. PCT/FR00/03664, filed on Dec. 22, 2000, now abandoned.

(30) Foreign Application Priority Data

Dec. 27, 1999 (FR) ..... 99 16512

(51) Int. Cl.[7] ..... H01H 13/06
(52) U.S. Cl. ..... 200/302.2; 200/512; 200/345
(58) Field of Search ..... 200/512–517, 200/520, 302.1, 302.2, 341, 345, 5 A

(56) References Cited

U.S. PATENT DOCUMENTS

| | | | | |
|---|---|---|---|---|
| 3,917,917 A | | 11/1975 | Murata | 200/5 A |
| 4,492,838 A | | 1/1985 | Fukukura | 200/159 A |
| 5,172,114 A | * | 12/1992 | Bedoya et al. | 200/342 |
| 5,270,499 A | * | 12/1993 | Marchuk et al. | 200/302.2 |
| 5,399,824 A | * | 3/1995 | Chen | 200/345 |
| 5,442,151 A | * | 8/1995 | Strang et al. | 200/302.2 |
| 5,734,136 A | * | 3/1998 | Newcomer et al. | 200/302.1 |
| 5,939,690 A | * | 8/1999 | Yasui et al. | 200/302.2 |
| 6,303,888 B1 | * | 10/2001 | Okamoto et al. | 200/406 |

FOREIGN PATENT DOCUMENTS

| | | | |
|---|---|---|---|
| DE | 2705756 A1 | 8/1978 | H01H/13/52 |
| DE | 7719352 | 3/1980 | H01H/13/52 |
| DE | 3501046 A1 | 7/1985 | G05G/1/02 |
| EP | 0110094 A1 | 6/1984 | H01H/13/70 |
| EP | 0558239 A1 | 9/1993 | H01H/13/70 |

* cited by examiner

*Primary Examiner*—Michael Friedhofer
(74) *Attorney, Agent, or Firm*—Roger C. Turner

(57) ABSTRACT

An electrical switch mounted on a circuit board and providing tactile feedback includes a domed tripper (18) and an elastomeric actuator (16) with a rod having an upper operating end (78) that can be depressed to snap down the tripper and close the switch. The actuator has a lower sealing lip (62) extending in a 360° circle around the tripper and lying against the circuit board upper face, to form a sealed cavity (56) containing the tripper. The 360° sealing lip of the actuator is pressed down against the circuit board by a cap (14) that has a side wall (26) with a lower edge (38) pressing down against the sealing lip. The cap has feet (42) extending down through holes in the circuit board, the feet having latches (48) that hold the cap in place.

8 Claims, 3 Drawing Sheets

F5

SEALED BOARD-MOUNTED ELECTRICAL SWITCH

CROSS-REFERENCE TO RELATED APPLICATION

This is a continuation-in-part of PCT application PCT/FR00/03664 filed Dec. 22, 2000, now abandoned which claims priority from French application 9916512 filed Dec. 27, 1999.

BACKGROUND OF THE INVENTION

One type of miniature individual switch includes a domed tripping member and an actuator that can be depressed to depress the middle of the tripping member. As the tripping member, or tripper moves down, it suddenly snaps down against a terminal to close the switch. The sudden snapping down creates a tactile feedback to a person depressing the actuator, to indicate that the switch has been closed. It is noted that the tripping member may be the form of a shallow pyramid instead of a continuously curved dome.

Electrical switches of this type are commonly mounted on circuit boards, together with many other components that are mounted on the circuit board. Since the tripper must repeatedly make and break contact with a terminal on the circuit board, it is desirable that the tripper lie in a substantially sealed environment to avoid corrosion and the presence of loose particles.

SUMMARY OF THE INVENTION

In accordance with one embodiment of the present invention, a tactile-feedback electrical switch is provided which accurately holds a tripper in a sealed environment on a circuit board using a minimum number parts. The switch includes an actuator molded of elastomeric material, and having a periphery with a lower sealing lip that surrounds the tripping member and which is pressed against the circuit board to seal thereagainst. The actuator has a center forming a rod and has a connecting portion connecting the rod to the periphery. The actuator forms a sealed cavity when its periphery is sealed to the circuit board. A cap which is fastened to the circuit board outside the actuator, presses down the sealing lip of the elastomeric actuator against the circuit board.

The tripper is formed with a plurality of arms that radiate from the middle of the tripper. The actuator has fingers that engage sides of the arms to accurately orient the tripper on the circuit board, and that retain the tripper prior to mounting on the circuit board. A skirt forming the periphery of the actuator lies in a press fit in the cap to keep them together prior to mounting on the circuit board. The inside of the actuator also has surfaces that press down against free outer ends of the tripper arms to press them against traces on the circuit board.

The rod formed at the center of the actuator includes a rod middle that merges with the connecting portion. The rod also has upper and lower rod parts that respectively project upward and downward from the rod middle. The rod upper part is exposed for receiving direct downward force to operate the switch. The rod lower part is tapered to have a small diameter lower face that lies substantially against the middle of the tripper.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
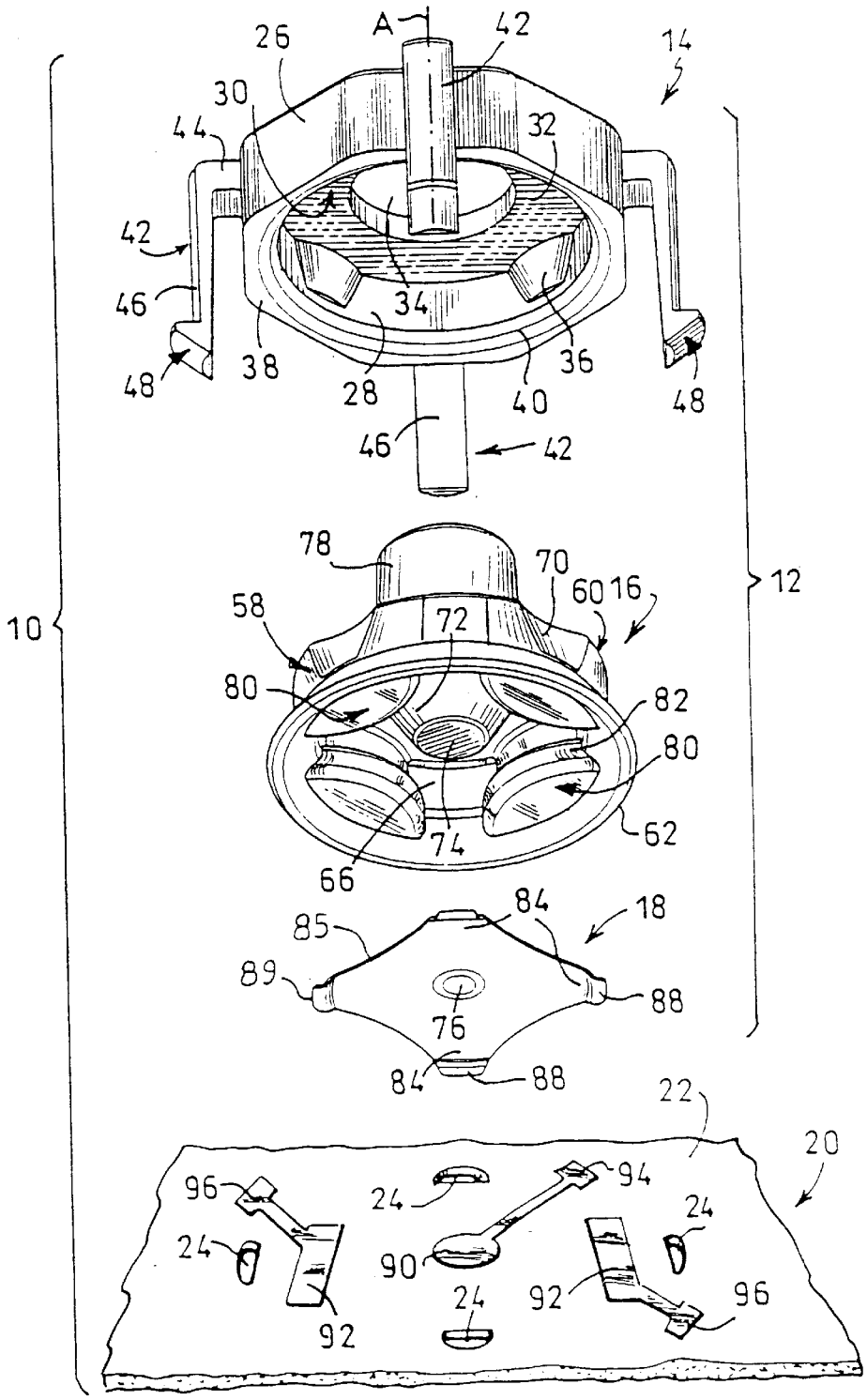
FIG. 1 is an exploded perspective view of an electrical switch of the present invention, and showing a portion of a circuit board constructed to hold the switch.
Figure 2:
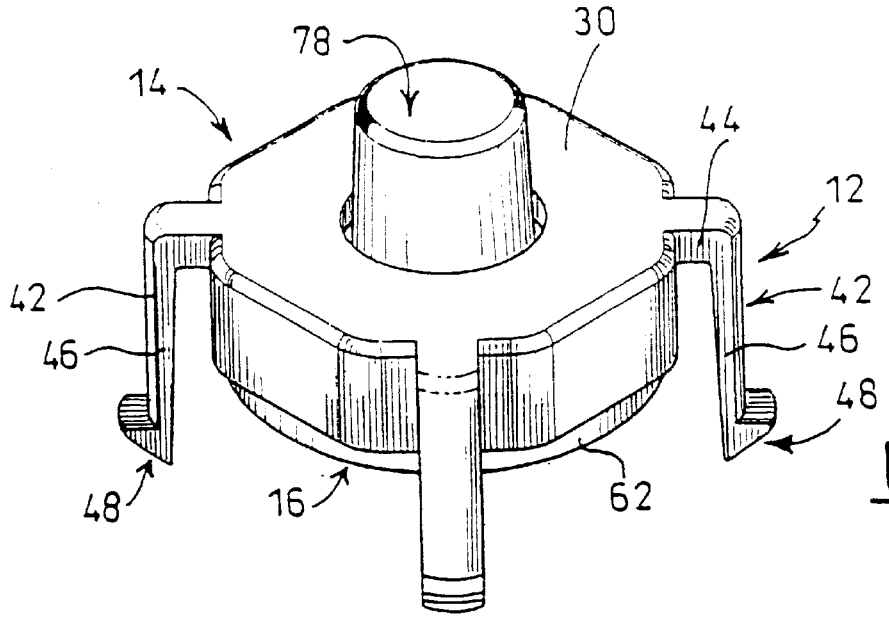
FIG. 2 is a top isometric view of the switch FIG. 1, shown fully assembled and ready to be mounted on the circuit board.

FIG. 1 illustrates an assembly 10 of a tactile-effect electrical switch 12 and a portion of a circuit board 20 on which the switch is mounted. The switch 12 has three components, including a cap 14, an actuating member or actuator 16, and a tripping member or tripper 18. The cap 14 is molded of an engineering plastic which is largely rigid, the actuator 16 is molded of an elastomeric material such as a silicone-based elastomer, and the tripper is formed of sheet metal such as stainless steel.

The circuit board 20 has an upper face 22 with four through holes 24 that enable the switch to be fastened to the circuit board. The circuit board also has electrically conductive traces 90, 92 on its surface that form terminals. The circuit board includes an insulative board and the conductive traces on the board.

The switch is basically symmetrical about two perpendicular vertical planes that each extends through a vertical axis A of the switch. The cap 14 has a side wall 26 with an inner face 28 which is largely cylindrical except for inward projections 36. The projections are spaced 90° apart about the axis A, and serve to orient the actuator 16. The cap has an upper wall 30 with a flat lower face 32 and with a central hole 34. The side wall 26 has a lower face or edge 38, with a bevel 40 at its inside that extends to the inner face 28.

Figures 4, 5, 6:
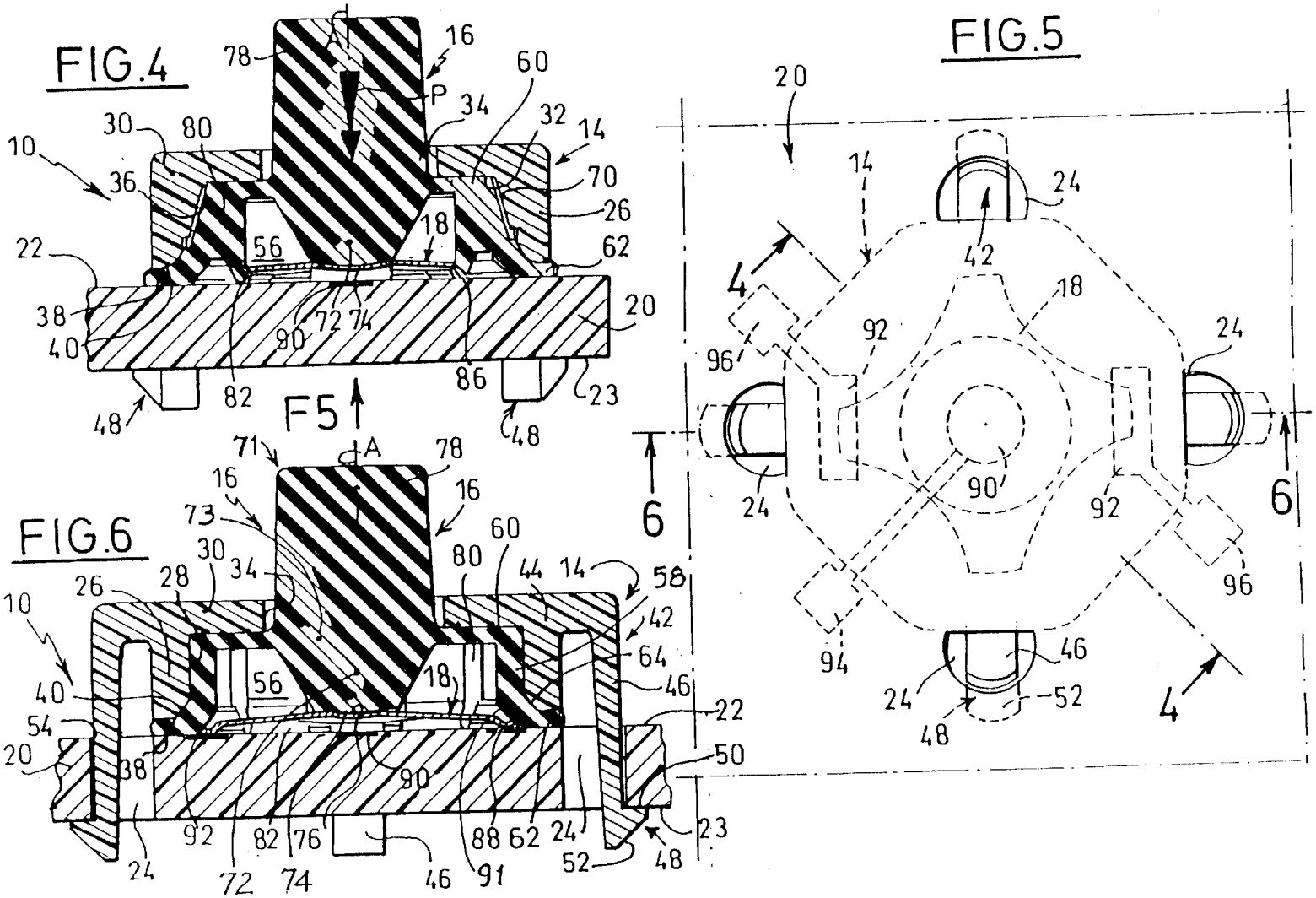
FIG. 4 is a sectional view taken on line 4—4 of FIG. 5, and showing the switch mounted on a circuit board.
FIG. 5 is a bottom view of the switch and circuit board of FIG. 4, taken along arrow F5 thereof, with most of the switch shown in hidden lines.
FIG. 6 is a sectional view similar to that FIG. 4, but taken on line 6—6 of FIG. 5.

The cap has four catching feet 42 that are angularly spaced apart by 90° about the axis A and which are each spaced 45° from the centers of two adjacent projections 36. Each foot has an upper section 44 extending radially outward from the top of the side wall 26 and a vertical section 46 with a free lower end 48 forming a hook. As shown in FIG. 6, each foot vertical section 46 extends down through a corresponding hole 24 in the circuit board. The lower end 48 forms a top face 50 that engages a lower face 23 of the circuit board. The free lower end or hook 48 has a beveled outer face 52 that enables the vertical sections 46 to bend as they pass down through the circuit board until the hooks snap under the circuit board.

FIG. 6 shows that the actuator 16 forms a sealed cavity 56, in combination with the circuit board 20, with the tripper 18 lying in the cavity. The actuator includes a cylindrical skirt 58 at its periphery, a center forming a rod 71, and a connecting portion 60 which extends largely radially between the rod 71 and skirt 58. The largely cylindrical skirt 58 has an axis lying on axis A, and has a lower end with a radially-outwardly extending flange forming a sealing edge or lip 62. The cap has a fillet or bevel at 40 and the lower portion of the skirt forms a bevel at 64 complimentary to the bevel on the cap.

The side wall 26 of the cap applies a downward force to the sealing lip 62 that compresses the lip against the circuit board to form a seal between the lip 62 and circuit board. The elastomeric lip 62 also resiliently pushes up the cap to help keep the hook 52 and the bottom of the feet pressed upward against the lower face 23 of the circuit board. Such sealing is useful to prevent extraneous material (solid particles, liquid, or gas) from entering the cavity 56 and either corroding the tripping member 18 or resulting in a particle that prevents the middle of the tripping member from engaging the trace or terminal 90. The rod 71 includes an upper portion 78 whose top is exposed so it can be manually depressed, and a lower portion 72 which is tapered to be progressively narrower at lower locations, and to form a lower face 74 that substantially engages the middle 76 of the tripper (it is possible to place a sheet between them). The rod has a middle 73 that lies between the upper and lower portions and that merges with the connecting portion 60.

FIG. 1 shows that the tripper 18 has four arms 84 that extend radially outward from the middle 76. Each arm has concave opposite sides or side edges 85. Also, the free end 88 of the arms, which form the periphery of the tripper, each includes a downwardly-offset tab 89 formed by two bends of about 90° each. When the tripper is moved down against the circuit board, two of the tabs 89 press against two of the outer traces 92 on the circuit board. FIG. 6 shows that the skirt inside bottom locations 91 are beveled and press the tripper arm tabs against the circuit board traces. The middle 76 of the tripper lies over the center trace 90. It is important that the rotational orientation of the tripper about the axis A be controlled, to assure that tabs 89 on opposite arms press against the outer traces 92.

The inside of the actuator skirt has fingers 80 that engage opposite edges 85 of the tripper arms to assure proper rotational orientation of the tripper. The outside of the actuator skirt has four outward projections 60 lying between recesses 70 in the skirt 58, and the cap 14 has four internal projections 36 that fit into the actuator recesses 70 to assure proper rotational orientation of the actuator with respect to the cap. The dimensions of the actuator and cap 16, 14 are controlled so that the skirt 58 mounts with a snug radial fit, or press fit, inside the cap 14. This retains the actuator 16 within the cap 14 so they can be handled as a unit prior to mounting on a circuit board.

FIGS. 4 and 6 show that when the connector is mounted on the circuit board, the connecting portion 60 of the actuator bears against the lower face 32 of the cap, although the elastomeric connecting portion can deflect downwardly when the rod 71 is pressed down to close the switch. The sealing lip 62 is pinched between the lower edge 38 of the cap and the upper face of the circuit board to seal the cavity.

Figure 3:
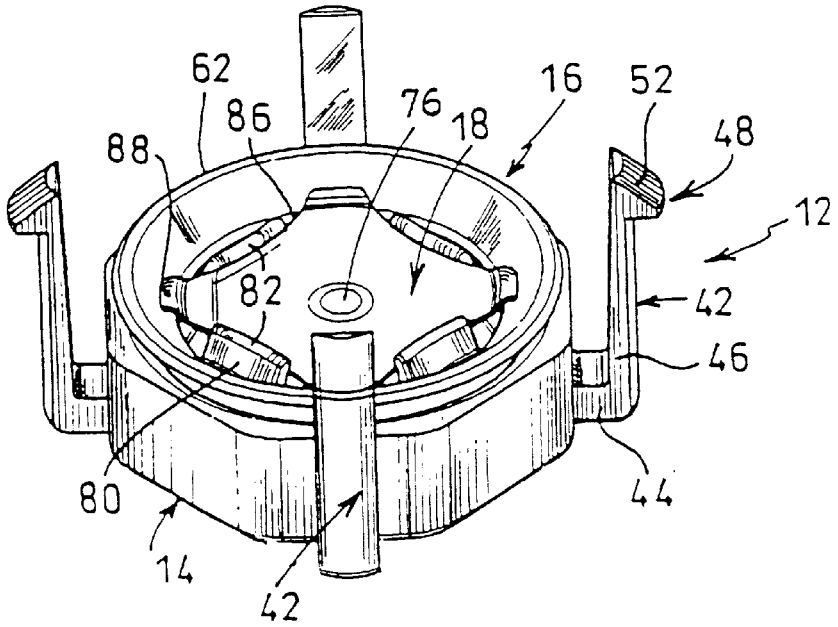
FIG. 3 is a bottom isometric view of the assembled switch of FIG. 2.

FIG. 3 shows that the tripper 18 is retained in the actuator 16 before the electrical switch that consists of the three parts 14, 16, 18 is mounted on a circuit board. The fingers 82 of the actuator not only engage edges of the tripper arms, but retain the tripper in the actuator by the arms pressing against the opposite edges of the tripper arms. FIG. 5 shows that the inner surfaces of the fingers are angled downward and toward the axis A to better retain the tripper. It is highly desirable that it be possible to assemble the three components of the electrical switch and transport and handle the switch as a unit prior to mounting it on the circuit board. The interference fit of the actuator skirt 58 (FIG. 6) in the cap and the fingers 82 that engage sides or edges of the tripper arms assure this.

FIG. 1 shows that the central trace 90 has a disk-shaped portion lying on the connector axis A, and it and the other two traces 92 extend to connection pads 94, 96 that lie radially outside the switch. In each of four possible rotational positions of the switch, that are angled 90° apart, two tabs 89 of the tripping member press against the opposite traces 92 on the circuit board. In FIG. 4, when the upper end 78 of the rod is pressed downward in the direction of arrow P, the center part of the dome moves down until the resistance to further downward movement suddenly decreases and the dome snaps down.

The design of the switch enables the switch to be mounted without requiring any soldering operations. Since the three parts of the switch tend to remain together, the switch or switch assembly is useful in the common pick-and-place technique for assembling components on a circuit board. Once the cap is pressed down and the hooks at the bottom of its feet latch to the lower face of the circuit board, the tripper is held in a sealed cavity formed between the elastomeric actuator and the circuit board. The overall dimensions of the switch are small. In a switch designed by applicant, the total height of the switch above the upper face of the circuit board was 5 mm, while the external diameter of the cap was 8.3 mm. In a variation of the above design, it is possible, by mechanical inversion, for the skirt 58 of the elastomeric actuator, to be provided with lugs that are snap-fastened into recesses in the cap to hold the actuator in the cap prior to the assembly. It is possible for the actuator to hold itself to the circuit board.

While terms such as "upper", "lower", etc. have been used to describe the invention as illustrated, the circuit board upper face and switch can be used in any orientation with respect to the Earth.

Thus, the invention provides a miniature tactile-effect electrical switch which has a minimum number of parts that hold together prior to mounting on a circuit board, and wherein the tripping member is held in a sealed cavity. The actor is molded as a single piece of elastomeric material, with a lower sealing edge or lip extending 360° around the tripping member and pressed against the circuit board upper face. A cap formed of more rigid material than the actuating member, is fastened to the circuit board and has a side wall with a lower edge that presses down against substantially the entire circumference of the sealing lip (any gaps in the side wall lower edge are small) to seal the lip against the circuit board and thereby form a substantially sealed cavity in which the tripper lies. The actuator includes a rod at the axis of the switch and a connecting portion extending largely horizontally from the middle of the height of the rod to the skirt, the connecting portion allowing the rod to move up and down. The rod has an upwardly-projecting upper portion that can be directly depressed and has a downwardly-extending lower portion that is tapered to have a small diameter face at its lower end that presses against the center of the tripper. The actuator has a tripper-positioning portion formed by a plurality of fingers that engage opposite side edges of radiating arms of the tripper to not only position the tripper but also to retain the tripper on the actuator. The actuator also has inside edges that press down tabs at the free ends of the tripper arms, against traces on the circuit board. The actuator lies in a press fit in the cap to hold it in place before mounting on a circuit board.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A tactile-effect electrical switch which includes a circuit board, the circuit board including a board having an upper face and at least a pair of conductive traces on said upper face, a tripper with a periphery and with a tripper middle that lies on a vertical axis over one of said traces, said tripper middle being depressable to snap down and connect said pair of traces, and an elastomeric actuator having a peripheral skirt and having an actuator center portion lying within said skirt, said actuator center portion having an upper end that can be depressed and said actuator center portion having a lower actuating face lying over said middle of said tripper, and said actuator having a connection portion that connects said skirt to said actuator center portion, wherein:

said tripper has a plurality of arms extending away from said tripper middle, each of said arms having opposite sides;

said actuator includes a tripper-positioning portion that engages the sides of a plurality of said arms to horizontally and rotationally position said tripper.

2. The switch described in claim 1 wherein:

said arms of said tripper have radially outer free ends, and at least one of said free ends has two bends of about 90° each to form a lowered tab that lies facewise against one of said conductive traces.

3. The switch described in claim 1 wherein:

said tripper positioning portion of said actuator includes a plurality of fingers that press largely horizontally against said arm sides to hold to said arm sides and thereby hold said actuator and tripper together prior to mounting on the circuit board.

4. A switch for mounting over traces of a circuit board comprising:

a tripper with a middle lying on an axis and a plurality of arms extending largely radially from said middle and having arm opposite sides;

an elastomeric actuator with a skirt that surrounds said tipper, a center portion that can be depressed and that lies over said tripper middle, and a connecting portion that connects said skirt and said center portion, said skirt forming fingers that engage said arm opposite sides.

5. The switch descried in claim 4 including:

a cap with a cap side that has an inside surface and that surrounds said skirt of said actuator, said skirt lying in a press fit with said cap side inside surface.

6. A tactile-effect electrical switch for mounting on a circuit board that has a board and a pair of conductive traces, to connect said traces when the switch is operated comprising:

a tripper with a periphery lying on one of said traces and with a middle that can be depressed to snap down against another of said traces and connect said pair of traces;

an actuator with an actuator center lying over said tripper middle and with an upper end that can be depressed;

a cap for fastening to said circuit board;

said actuator is formed of elastomeric material and has a lower sealing lip;

said cap has a side wall with a lower end that lies over and against said actuator sealing lip, to press the sealing lip against the circuit board when the switch is mounted on the circuit board;

said tripper has a plurality of arms extending away from said tripper middle, each of said arms having opposite sides;

said actuator lies in a press fit in said cap, and said actuator has a plurality of downwardly-extending fingers that engage said sides of said tripper arms and resist the tripper from falling out of said actuator, whereby to provide a switch with parts that remain together before mounting on a circuit board.

7. A tactile-effect electrical switch which comprises a circuit board that includes a board having an upper face and a pair of conductive traces on said upper face, a tripper with a tripper periphery and with a tripper middle that lies on a vertical axis over one of said traces, said tripper middle being depressable to snap down and connect said pair of traces, an actuator that can be depressed and that depresses said tripper middle, and an upper cap that is fastened to said circuit board and that surrounds part of said actuator, wherein: said actuator is a one-piece elastomeric member with an actuator periphery forming a lip that is pressed against said circuit board to seal thereagainst, said actuator having a center forming a rod that has upper and lower rod parts, and said actuator having a connecting portion that extends between said center and said periphery;

said upper rod part having an exposed upper end and said lower rod part lying substantially against said tripper middle, with said rod upper and lower parts being thicker than said connecting portion;

said cap has upper and lower ring-shaped walls, said lower ring-shaped wall lying above and pressing down said actuator periphery against said circuit board;

said cap upper ring-shaped wall forms a hole with a hole upper end that closely surrounds said rod upper end.

8. The switch described in claim 7 wherein:

said cap upper ring-shaped wall has a downwardly-facing lower face, and said actuator connecting portion extends horizontally and radially outward from said rod and lies against said lower face of said cap upper ring-shaped wall.

* * * * *